US005865688A

United States Patent [19]

Bae

[11] Patent Number: 5,865,688

[45] Date of Patent: Feb. 2, 1999

[54] GOLF CLUB SHAFT HAVING MULTIPLE FLEX POINTS

[76] Inventor: Sung Wuk Bae, San 36, Upchun-Ri, Jain-Myun, Kyungsan-Gun, Rep. of Korea

[21] Appl. No.: 693,832

[22] Filed: Aug. 1, 1996

Related U.S. Application Data

[60] Provisional application No. 60/001,789 Aug. 2, 1995.

[51] Int. Cl.[6] ..... A63B 53/10; A63B 53/12

[52] U.S. Cl. ..... 473/323

[58] Field of Search ..... 473/316–323, 473/289

[56] References Cited

U.S. PATENT DOCUMENTS

| | | | |
|---|---|---|---|
| D. 92,571 | 6/1934 | Barnhart | 473/323 |
| 2,050,554 | 8/1936 | Barnhart | 473/323 |
| 2,153,550 | 4/1939 | Cowdery | 473/323 |
| 2,153,880 | 4/1939 | Barnhart | 473/323 |
| 2,250,441 | 7/1941 | Vickery | 473/323 |
| 2,341,053 | 2/1944 | Mason | 473/289 |
| 3,003,275 | 10/1961 | Reid | 473/318 |
| 4,122,593 | 10/1978 | Braly | 473/289 |
| 4,283,446 | 8/1981 | McLain | 428/36.3 |
| 4,319,750 | 3/1982 | Roy | 473/320 |
| 5,685,781 | 11/1997 | Pedersen | 473/318 |

FOREIGN PATENT DOCUMENTS 482164 3/1938 United Kingdom .

*Primary Examiner*—Sebastiano Passaniti
*Assistant Examiner*—Stephen L. Blau
*Attorney, Agent, or Firm*—Graham & James LLP

[57] ABSTRACT

A golf club shaft is formed of graphite and includes an upper portion and tapers to a lower portion. The upper portion is designed to couple with a handle while the lower portion is adapted to coupled to a club head. A first flex point is disposed between the upper portion and the lower portion of the shaft. A second flex point is disposed between the first flex point and the lower portion of the shaft. A third flex point is disposed between the second flex point and the lower portion of the shaft. The shaft tapers to the first flex point and widens to taper to each successive flex point.

13 Claims, 2 Drawing Sheets

GOLF CLUB SHAFT HAVING MULTIPLE FLEX POINTS

APPLICATION DATA

This application claims the benefit under Title 35, United States, § 119(e) of U.S. Provisional Application No. 60/001,789, filed Aug. 2, 1995.

BACKGROUND OF THE INVENTION

1. Field of the Invention

The present invention relates to a golf club shaft. In particular, the golf club shaft includes three or more flex points distributed along the length of the shaft.

2. Background

The functionality of a golf club shaft is determined by its torque, impact strength, frequency, and flex point location. These factors determine the capacity of the club to strike a ball, the distance and direction of a struck ball, and the tolerance of the shaft during impact. All of these factors may be altered by the manufacturer to achieve a functional shaft. The flex point location, however, is the factor most often selected by a golfer when choosing a set of golf clubs.

In choosing a flex point, a golfer is often asked to choose between three locations. A flex point located proximate the club head is termed a "low point". A flex point in the middle of the shaft is termed a "mid-point". A flex point located proximate the handle is termed a "high point". Typically, a low point shaft sacrifices distance for less vibration while a high point shaft increases vibration to obtain greater distance. A mid-point shaft tries to achieve a compromise in both distance and vibration. None of these options, however, provide maximum distance and reduced vibration.

Accordingly, it is an object of the present invention to increase distance and reduce vibration in a golf club shaft.

SUMMARY OF THE INVENTION

The present invention increases ball-carrying distance and reduces shaft vibration. In particular, the golf club shaft of the present invention includes three flex points disposed along the length of the shaft. At each point, the diameter of the shaft expands to permit the shaft to flex at that point. When the shaft is swung, the shaft flexes from a high flex point to a mid flex point to a lower flex point. The increased number of flex points allows the shaft to improve ball-carrying distance. Further, the flex movement from high point to mid point to low point stabilizes the swing, thereby reducing vibration.

A more complete understanding of the golf club shaft will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
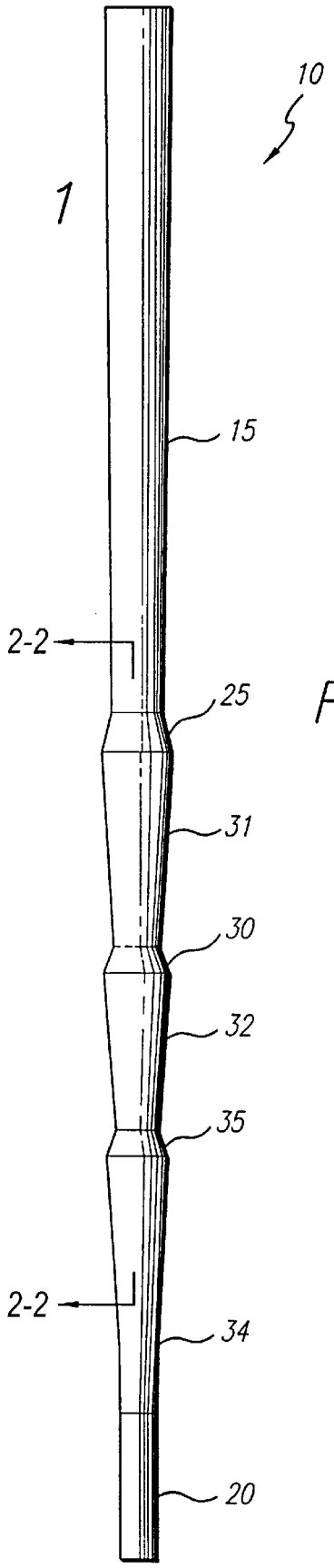
FIG. 1 is a forward perspective view of the golf club shaft of the present invention.
Figure 2:
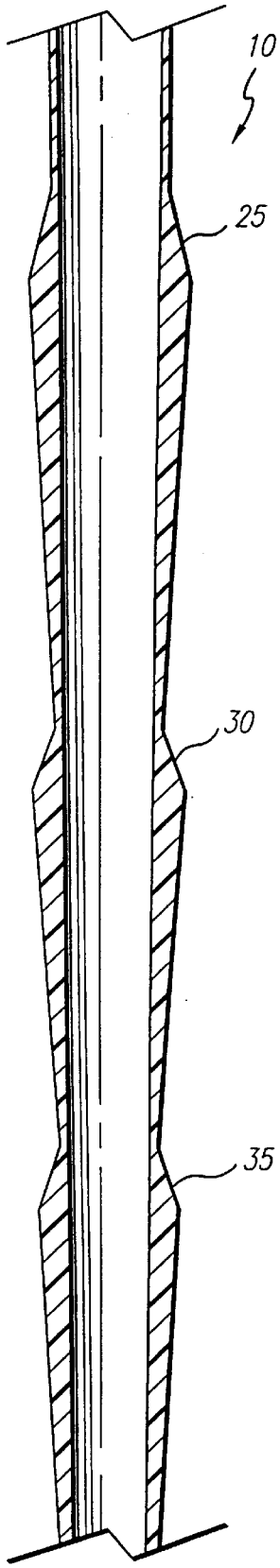
FIG. 2 is a perspective view of the golf club shaft taken along the lines 2—2 of FIG. 1.

Referring first to FIG. 1, a golf club shaft 10 is preferably formed of high modulus graphite, although aluminum, aluminum alloy, steel, or other synthetic resins may be used. The shaft 10 includes an upper portion 15, a lower portion 20 and three flex points 25, 30, and 35. A first middle portion 31 is disposed between the first flex point 25, and the second flex point 30. A second middle portion 32 is disposed between the second flex point 30 and the third flex point 35. The upper portion 15 of the shaft 10 is designed to be coupled to a handle. The lower end 20 of the shaft 10 is designed to be coupled to a club head. The diameter of the upper portion 15 is larger than the diameter of the lower portion 20. The shaft has a preferred length of 1143 millimeters, although the shaft length may vary for different golfers. The shaft 10 generally tapers from the upper portion 15 to the lower portion 20. As shown in FIG. 2, the golf club shaft 10 is preferably hollow.

Three flex points 25, 30, and 35 are located along the shaft to temporarily suspend the tapering of the golf club shaft at those points. Each flex point constitutes a point along the shaft 10 where the shaft's diameter tapers. In a preferred embodiment, the upper portion 15 of the shaft 10 has a diameter of approximately 15.20 millimeters (±0.2 mm). The shaft tapers from the upper portion 15 to the first flex point 25. The diameter of the shaft 10 is approximately 12.50 mm at the first flex point 25. From the flex point 25, the shaft 10 diameter expands to approximately 14.30 mm (±0.2 mm). From this expanded diameter position, the shaft tapers again until the second flex point 30. The diameter of the shaft 10 at the second flex point 30 is approximately 11.50 mm. The diameter of the shaft 10 then expands to a diameter of 14.00 mm (±0.2 mm). From this second position, the shaft 10 tapers to the third flex point 35. The diameter of the shaft 10 at the third flex point is approximately 10.50 mm. The shaft then expands from the third flex point 30 to a diameter of 12.00 (±0.2 mm). Finally, the shaft 10 tapers to a diameter of 8.50 mm (±0.2 mm). The lower portion of the shaft remains straight for the final 125 mm of the shaft's length.

Although the length of the shaft 10 may vary, the flex points are spaced apart from the club head at distances that are proportional to the entire length of the shaft 10. The first flex point 20 is preferably spaced apart from the club head at a distance of 50–55% of the entire length of the shaft. Preferably, the spacing distance of the first flex point 20 from the club head is 54.2% of the entire shaft length. The second flex point 30 is spaced apart from the club head at a distance that can range from 35–40% of the entire shaft length, with a preferred distance of 38.5% of the club's length. The third flex point 35 is spaced apart from the club head at a distance that ranges from 25–30% of the shaft's length, with a preferred distance of 27.1% of the entire length. The total flex position of the shaft is approximately 36.7% of the entire shaft length.

Figure 3:
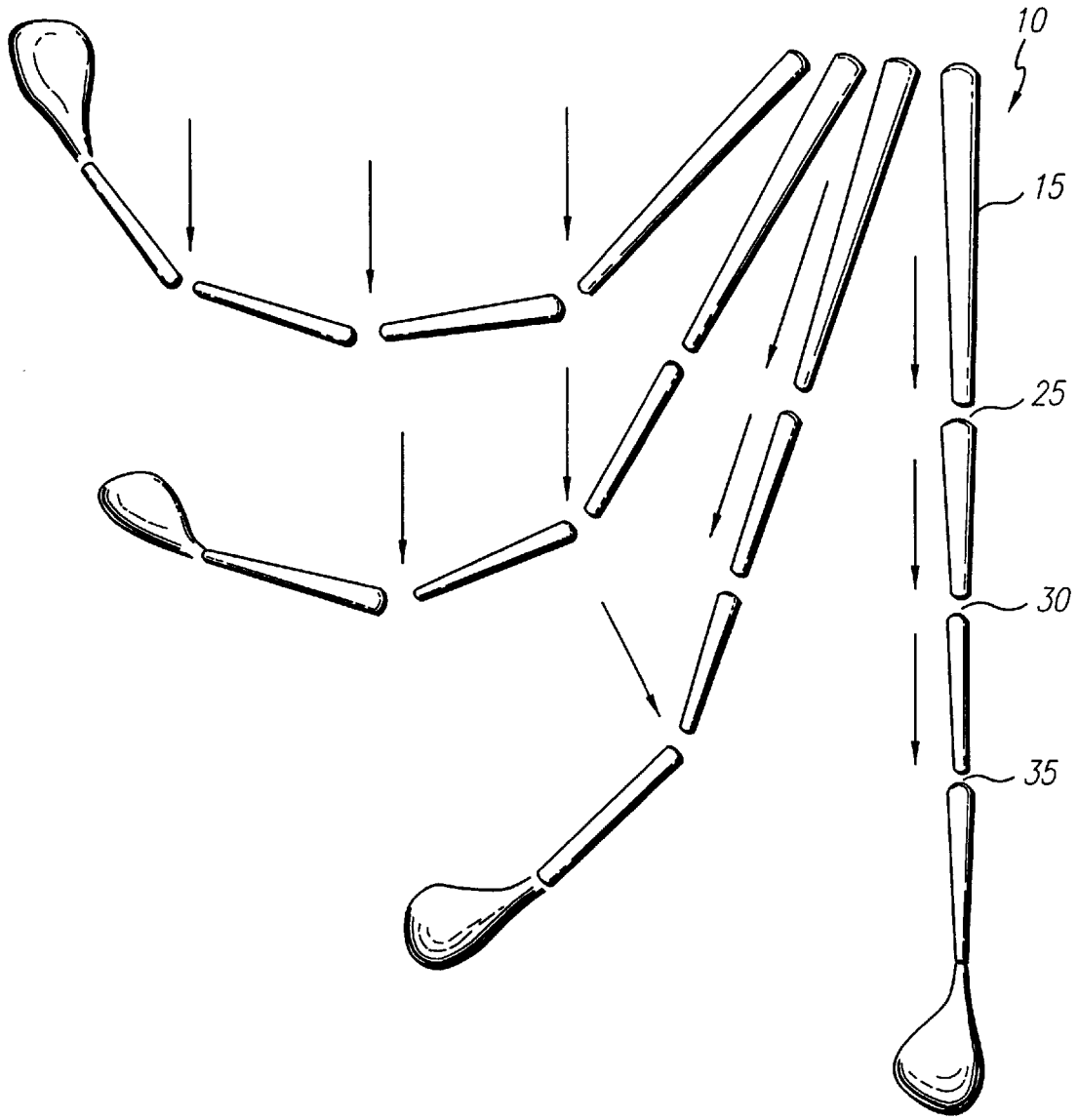
FIG. 3 is a diagram of the golf club shaft during a swinging motion.

FIG. 3 shows the flexing of the shaft during a golf swing. As shown, the shaft 10 flexes initially at the first flex point 25. As the shaft 10 continues to move, the flexing of the shaft 10 continues at the second flex point 30. The flexing eventually is transferred to flex point 35. The step-by-step flex movement of the shaft 10 restrains vibration of the shaft and assists in stabilizing the swing and improving the direction of ball flight. Moreover, the step-by-step motion allows the elastic reflection within the shaft to transfer from the first flex point 25 to the second flex point 30 to the third flex point 35 and eventually to the club head. This transfer of energy results in increased distance.

Having thus described a preferred embodiment of a golf club shaft, it should be apparent to those skilled in the art that certain advantages of the within system have been achieved. It should also be appreciated that various modifications, adaptations, and alternative embodiments thereof may be made within the scope and spirit of the present invention. For example, three flex points have been illustrated, but it should be apparent that the inventive concepts described above would be equally applicable to four or more flex points. The invention is further defined by the following claims.

What is claimed is:

1. A golf club shaft comprising:

an upper portion;

a lower portion;

a first middle portion;

a second middle portion;

a first flex point disposed between the upper portion and the first middle portion, whereby the first flex point is where the maximum bending occurs along the upper and first middle portions during a golf swing;

a second flex point disposed between the first middle portion and the second middle portion, whereby the second flex point is where the maximum bending occurs along the first and second middle portions during a golf swing; and a third flex point disposed between the second middle portion and the lower portion, whereby the third flex point is where the maximum bending occurs along the second middle and lower portions during a golf swing.

2. The golf club shaft, as recited in claim 1, wherein the upper portion tapers to the first flex point.

3. The golf club shaft, as recited in claim 2, wherein a diameter of the first middle portion includes a taper to the second flex point.

4. The golf club shaft, as recited in claim 3, wherein a diameter of the second middle portion includes a taper to the third flex point.

5. The golf club shaft, as recited in claim 1, wherein the shaft is formed of high modulus graphite.

6. The golf club shaft, as recited in claim 1, wherein an end of the shaft is located on the lower portion opposite the third flex point, and wherein the first flex point is spaced apart from the end of the shaft at a distance of 50–55% of an entire length of the shaft.

7. The golf club shaft, as recited in claim 1, wherein, when the shaft is swung, the shaft flexes first at the first flex point, second at the second flex point, and third at the third flex point.

8. A golf club shaft comprising:

an upper portion;

a lower portion;

a first flex point disposed between the upper portion and lower portion, the upper portion tapering to the first flex point;

a second flex point disposed between the first flex point and the lower portion;

a first middle portion disposed between the first flex point and the second flex point, the first middle portion tapering to the second flex point;

a third flex point disposed between the second flex and the lower portion; and a second middle portion disposed between the second flex point and the third flex point, the second middle portion tapering to the third flex point;

wherein the first flex point is where the maximum bending occurs alone the upper and first middle portions during a golf swing;

wherein the second flex point is where the maximum bending occurs along the first middle and second middle portions during a golf swing; and wherein the third flex point is where the maximum bending occurs along the second middle and lower portions during a golf swing.

9. The golf club shaft of claim 8 wherein the first flex point has a first diameter which is smaller then a maximum diameter of the first middle portion.

10. The golf club shaft of claim 9 wherein the second flex point has a second diameter which is smaller than a maximum diameter of the second middle portion.

11. The golf club shaft of claim 10 wherein the third flex point has a third diameter which is smaller than a maximum diameter of the lower portion.

12. The golf club shaft of claim 11 wherein the first diameter is larger than the second diameter.

13. The golf club shaft of claim 12 wherein the second diameter is larger than the third diameter.

* * * * *